United States Patent [19]

Saito et al.

[11] Patent Number: 4,584,421

[45] Date of Patent: Apr. 22, 1986

[54] METHOD FOR THERMAL DECOMPOSITION OF PLASTIC SCRAPS AND APPARATUS FOR DISPOSAL OF PLASTIC SCRAPS

[75] Inventors: Kiyoshi Saito, Sapporo; Mitsuo Nanba, Hiroshima, both of Japan

[73] Assignees: Agency of Industrial Science and Technology; Ministry of International Trade and Industry, both of Tokyo; Sun-Esu Co., Ltd., Age, all of Japan

[21] Appl. No.: 593,369

[22] Filed: Mar. 26, 1984

[30] Foreign Application Priority Data

Mar. 25, 1983 [JP] Japan ..... 58-48927
Mar. 25, 1983 [JP] Japan ..... 58-48928
Mar. 25, 1983 [JP] Japan ..... 58-48929

[51] Int. Cl.[4] ..... C07C 3/26
[52] U.S. Cl. ..... 585/241; 585/648
[58] Field of Search ..... 585/241, 648

[56] References Cited

U.S. PATENT DOCUMENTS 2,431,454 11/1947 Berk et al. ..... 585/241
2,906,786 9/1959 Hendrickson ..... 585/241
3,901,951 8/1975 Nishizaki ..... 585/925
3,956,414 5/1976 Oshima ..... 585/241
4,143,086 3/1979 Carle et al. ..... 585/241
4,214,110 7/1980 Moroe et al. ..... 585/241
4,251,500 2/1981 Morita et al. ..... 585/241
4,429,172 1/1984 Zellerhoff et al. ..... 585/241
4,458,095 7/1984 Wingfield, Jr. et al. ..... 585/241
4,515,659 5/1985 Wingfield, Jr. et al. ..... 585/241

FOREIGN PATENT DOCUMENTS 0042806 12/1970 Japan ..... 585/241
0047912 2/1973 Japan ..... 585/241
0123494 4/1973 Japan ..... 585/241
0092373 12/1973 Japan ..... 585/241
0041001 4/1976 Japan ..... 585/241
0045302 4/1978 Japan ..... 585/241

*Primary Examiner*—John Doll
*Assistant Examiner*—Lance Johnson
*Attorney, Agent, or Firm*—Schwartz & Weinrieb

[57] ABSTRACT

Plastic scraps are subjected to thermal decomposition in the presence of zeolite type catalyst and converted into a liquid hydrocarbon oil.

17 Claims, 2 Drawing Figures

METHOD FOR THERMAL DECOMPOSITION OF PLASTIC SCRAPS AND APPARATUS FOR DISPOSAL OF PLASTIC SCRAPS

FIELD OF THE INVENTION

This invention relates to a method and apparatus for thermally decomposing plastic scraps and thereby producing liquid hydrocarbon oil useful as fuel or crude raw material.

BACKGROUND OF THE INVENTION

Plastic scraps, like other refuse, have come to occur in huge volumes with the growth of industry and the economy. Their volumes are steadily increasing year after year.

These plastic scraps have been so far disposed of mostly by being dumped at land reclamation sites, processed for the production of flower boxes and piles, and sorted out and reclaimed as raw material. Since they occur everyday in such huge volumes, such measures of disposal are hardly sufficient for their complete disposal. The open areas and the methods adopted for their disposal are rapidly reaching their limits.

If such methods as combustion and gasification become capable of being properly carried out, they will obviously make complete disposal of plastic scraps possible.

Unfortunately, the combustion of plastic scraps entails partial generation of heat and temperatures so high as to defy control by existing techniques of combustion and, moreover, evolves noxious gas and soot in amounts so large as to cause a public nuisance by air pollution.

There may be conceived an idea of partially oxidizing plastic scraps or thermally decomposing them at temperatures exceeding 700° C. and utilizing the product of the partial oxidization or thermal decomposition as gaseous fuel. Since this operation involves pretreatments such as collection, washing, pulverization, and conveyance and necessitates installation of a reactor and a gas tank and consumption of combination air, it requires a huge cost investment in equipment and involves high operating costs. Thus, this idea is hardly practicable economically.

Plastic scraps are a poor conductor of heat. When a reaction vessel filled with plastic scraps for thermal decomposition is operated, any attempt to keep the internal temperature of the reaction vessel uniform brings about a wide difference of temperature between the internal wall and the external wall of the reaction vessel and entails deposition of carbon on the internal wall of the reaction vessel during its operation. The deposited carbon can be removed by the force exerted thereon as with a stirring rod, for example. When the amount of the deposited carbon is large, however, there is a possibility that the use of the stirring rod will generate torque even to the extent of breaking the reactor.

OBJECT OF THE INVENTION

With a view to a practical method for disposal of plastic scraps by thermal decomposition, this invention is aimed at providing a method which effects this thermal decomposition by a simple process without entailing deposition of carbon and permits recovery of hydrocarbon oil of high quality.

SUMMARY OF THE INVENTION

To accomplish the object described above, this invention subjects plastic scraps to thermal decomposition in the presence of an alumina-iron oxide type, silicic acid-iron oxide type, or zeolite type catalyst and converts them to a liquid hydrocarbon oil.

BRIEF DESCRIPTION OF THE DRAWINGS

The other functions and characteristic features of this invention will be apparent from the further disclosure of the invention to be given hereinbelow with reference to the accompanying drawings, wherein.

DESCRIPTION OF PREFERRED EMBODIMENTS

Figure 1:
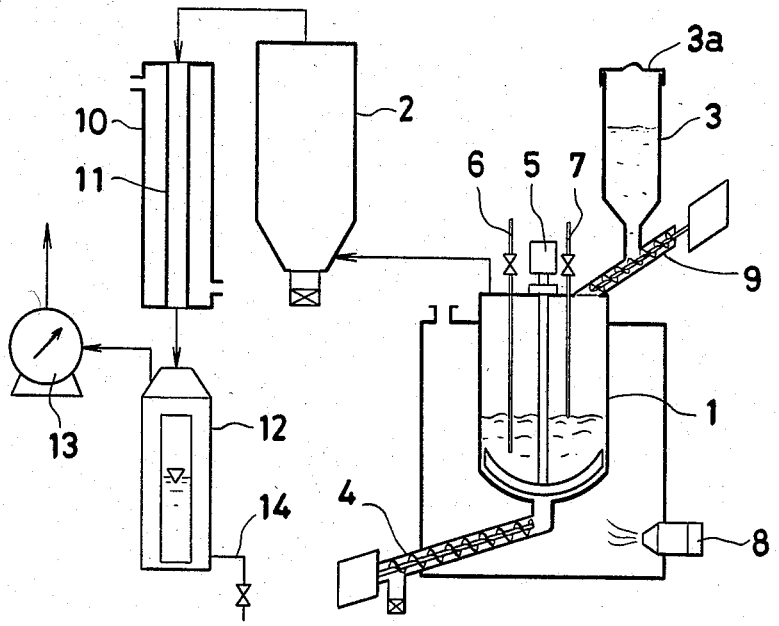
FIG. 1 is a schematic diagram illustrating a typical apparatus of this invention for thermal decomposition of plastic scraps.

This invention is directed to the thermal decomposition of plastic scraps in the presence of an alumina-iron oxide type, silicic acid-iron oxide type or zeolite type catalyst and the consequent conversion of the plastic scraps into a liquid hydrocarbon oil.

Now, the first embodiment of this invention will be described. This embodiment comprises melting plastic scraps with heat, then thermally decomposing the molten plastic mass at temperatures in the range of 440° to 470° C., and passing the vaporous product of thermal decomposition through a bed of catalyst particles 1 to 15 mm in diameter preheated to 350° to 470° C. thereby subjecting the vaporous product to secondary thermal decomposition and producing a hydrocarbon oil.

This invention requires the thermal decomposition of plastic scraps to be carried out at temperatures in the range of 440° to 470° C. because the speed of the formation of the liquid hydrocarbon oil is slow and the yield of the production of the liquid hydrocarbon oil is low when the temperature of thermal decomposition falls outside this range.

Examples of the catalyst usable advantageously in this thermal decomposition include alumina-iron oxide type, silicic acid-iron oxide type, and zeolite type catalysts. Use of synthetic zeolite as a zeolite type catalyst is fairly effective. Natural zeolite, when burnt at temperatures in the range of 500° to 550° C., is used more effectively as a zeolite type catalyst. When the zeolite used as raw material for the catalyst happens to be smeared with deposited carbon, desired removal of the deposited carbon may be obtained by subjecting this zeolite to the burning treatment as described above and subsequently washing the burnt zeolite.

The upper limit of the diameter of catalyst particles making up the catalyst bed is fixed at 15 mm for the purpose of ensuring through contact between the vaporous product of thermal decomposition and the catalyst particles. The lower limit of the diameter is fixed at 1 mm for the purpose of ensuring formation of gaps in the catalyst bed for passage of a gas.

The range, 350° to 470° C., is fixed for the temperature of the catalyst bed because at temperatures below 350° C., the activity of the catalyst is not sufficient and the secondary thermal decomposition entails by-production of wax and, at temperatures above 470° C., the thermal decomposition proceeds excessively to lower the yield of the liquid hydrocarbon oil. When the temperature of the catalyst bed falls within this range, 350° to 470° C., the molecular weights of the produced hydrocarbons are confined within a narrow range. Consequently, there is obtained a hydrocarbon oil of high quality which is liquid at room temperature.

When a product of thermal decomposition having a wide molecular weight distribution of $C_5$ to $C_{42}$ is passed through the catalyst bed kept at temperatures in the range of 350° to 470° C., for example, the produced oil has a molecular weight distribution of $C_5$ to $C_{24}$ or $C_5$ to $C_{29}$.

The molecular weight distribution is thus reduced because the vaporous product of the thermal decomposition, while passing the catalyst bed, undergoes reforming and consequent change in the percentage composition.

In terms of average molecular weight, while the product of the thermal decomposition in the absence of the catalyst bed has a molecular weight in the range of 245 to 285, the product of the secondary thermal decomposition effected in the presence of the catalyst bed has a molecular weight in the range of 135 to 190. The molecular weights of the component hydrocarbons of the produced oil are distributed in a narrow range and tend toward the lower limit side rather than toward the upper limit side. Thus, the liquid hydrocarbon oil is suitable as fuel and as raw material for industrial use.

The plastic, scraps which can be advantageously disposed of by this invention are various thermoplastic resins such as, for example, polyethylene, atactic polypropylene, polypropylene, polybutylene, and other similar olefinic homopolymers, polystyrene and other similar homopolymers, copolymers of ethylene, propylene, butylene, styrene, butadiene, and the like, with other copolymerizable monomers, and cross-linked polyethylene. The thermal decomposition by this invention can be performed particularly effectively on polyolefinic plastic scraps.

Now, the second embodiment of this invention will be described. This embodiment comprises feeding plastic scraps in conjunction with a catalyst to a preliminary reaction vessel and melting therein the plastic scraps with heat in the presence of the catalyst, feeding the molten plastic mass in conjunction with the catalyst to a main reaction vessel, subjecting the molten plastic mass to thermal decomposition in the presence of the catalyst at temperatures in the range of 400° C. to 470° C., recovering the vaporous product of thermal decomposition thereby converting the molten plastic mass into a liquid hydrocarbon oil, and suitably extracting the catalyst from the main reaction vessel as the catalyst is deteriorated with use.

The same catalyst as used in the first embodiment described above can be effectively used in this second embodiment. Among other types of catalyst, the zeolite type catalyst functions particularly advantageously. The amount of the catalyst to be added to the raw material is at least 5% by weight, practically 5 to 10% by weight, based on the amount of the raw material.

In this embodiment, the speed of the distillation of the product of thermal decomposition can be increased and the occurrence of carbon can be curbed by carrying out the thermal decomposition of plastic scraps at temperatures in the range of 400° to 470° C. in the presence of the aforementioned catalyst.

Under a fixed temperature condition, the speed of the distillation of the product obtained by this invention is 3.0 to 3.8 times the speed obtained where plastic scraps are directly subjected to thermal decomposition.

In accordance with this invention, since the plastic scraps and the catalyst are mixed within the preliminary reaction vessel and heated to a temperature of about 360° C., the plastic scraps are allowed to permeate the catalyst to ensure thorough mixture of the plastic scraps with the catalyst. Consequently, the supply of the molten plastic mass to the main reaction vessel proceeds smoothing and contributes to smoothening the thermal decomposition of the molten plastic mass in the main reaction vessel. These favorable reaction conditions explain the great difference in the speed of distillation described above.

When the mixture of the plastic scraps with the catalyst is subjected to thermal decomposition within the main reaction vessel at temperatures in the range of 400° to 470° C., it undergoes reforming and consequent change in the percentage composition. The vaporous distillate consequently obtained is a liquid hydrocarbon oil of high quality which is suitable as fuel or as raw material for industrial use.

In accordance with this invention, therefore, effective reclamation of the quality hydrocarbon oil from plastic scraps and perfect prevention of air pollution can be attained at the same time.

The plastic scraps on which this embodiment of the invention can be advantageously carried out are the same as those described above as usable for the first embodiment.

Now, the third embodiment of this invention will be described. Similar to the second embodiment, this third embodiment comprises feeding plastic scraps in conjunction with a catalyst to a preliminary reaction vessel, melting the plastic scraps with heat therein, feeding the molten plastic mass to a main reaction vessel, and subjecting the molten plastic mass while under agitation to thermal decomposition in the presence of the catalyst at temperatures in the range of 400° to 470° C. This embodiment further comprises passing the vaporous product of the thermal decomposition in the main reaction vessel to a second reaction vessel accommodating therein a catalyst bed of catalyst particles 1 to 15 mm in diameter heated to 350° to 470° C. thereby subjecting the vaporous product of thermal decomposition to a secondary thermal decomposition and thereby effecting conversion thereof to a liquid hydrocarbon oil.

In accordance with this embodiment, since the plastic scraps are thermally treated in conjunction with the catalyst within the preliminary reaction vessel, the liquid product of this thermal treatment is forwarded in a partially decomposed state in conjunction with the catalyst to the main reaction vessel, there to be subjected to further decomposition by heat. The catalyst in the main reaction vessel which has been deteriorated by decomposition of carbon, for example, is suitably withdrawn from the main reaction vessel. Thus, the reaction velocity obtainable in the present embodiment is several times that of the conventional thermal decomposition. In this manner, the catalytic activity within the main reaction vessel can be kept constant.

Further in accordance with this embodiment, catalyst particles about 10 mm in diameter are held inside the main reaction vessel and kept stirred therein at temperatures in the range of 400° to 470° C. As a result, the internal temperature of the main reaction vessel can be uniformly maintained and the carbon produced by the thermal decomposition is contained in the catalyst particles and, therefore, is prevented from adhering to the internal surface of the main reaction vessel.

Further in accordance with this embodiment, since the thermal decomposition of plastic scraps is effected at temperatures in the range of 400° to 470° C. in the presence of the catalyst, the speed of the distillation of the product of thermal decomposition can be heightened and the formation of carbon can be prevented.

Since the plastic scraps are mixed with the catalyst and heated to a temperature of about 360° C. inside the preliminary reaction vessel, the plastic scraps are allowed to permeate the catalyst enough to ensure thorough mixture of the plastic scraps with the catalyst. As a result, the supply of the molten plastic mass to the main reaction vessel proceeds smoothly enough to accelerate the thermal decomposition in the main reaction vessel.

Further in accordance with this embodiment, the plastic scraps are subjected, while under agitation, to thermal decomposition at temperatures in the range of 400° to 470° C. in the presence of the catalyst within the main reaction vessel and the vaporous product of the thermal decomposition occurring within the main reaction vessel is passed to the second reaction vessel accommodating therein a catalyst bed formed of catalyst particles 1 to 15 mm in diameter and kept at temperatures in the range of 350° to 470° C. to be subjected to catalytic decomposition. Thus, there is obtained a liquid hydrocarbon oil of high quality which is suitable as fuel or as raw material for industrial use.

Particularly in accordance with this embodiment, since the vaporous product of thermal decomposition is passed through the catalyst bed under the conditions described above and subjected to catalytic decomposition, it undergoes reforming into a liquid hydrocarbon oil of high quality.

The catalyst to be used in this embodiment and the plastic scraps to be treated thereby may be the same as those used in the first and second embodiments of the invention described above. In the treatment according to the present embodiment, the temperature condition is fixed for the same reason as in the treatment of either of the preceding embodiments.

Now, the present invention will be described specifically with reference to the accompanying drawings. FIG. 1 is a schematic diagram of an apparatus for the thermal decomposition treatment of plastic scraps in accordance with the first or third embodiment of this invention described above.

This apparatus comprises a first reaction vessel 1, a second reaction vessel 2 disposed above the first reaction vessel 1 and provided therein with a catalyst bed formed of catalyst particles 1 to 15 mm in diameter, a preliminary reaction vessel 3 disposed above the first reaction vessel 1, and means 4 for withdrawing deteriorated catalyst disposed at the bottom of the first reaction vessel 1.

The first reaction vessel 1 is provided at the center of the interior thereof with a stirrer means 5. A thermometer 6 formed of a thermocouple and a level gauge 7 are inserted into the first reaction vessel 1.

The second reaction vessel 2 accommodates therein a catalyst bed formed of burnt zeolite particles about 10 mm in diameter. Further the first reaction vessel 1 is provided with a burner 8 and the second reaction vessel 2 is provided with a heater (not shown). The burner 8 and the heater are operated so that the internal temperature of the first reaction vessel will be maintained in the range of 400° to 470° C. and the internal temperature of the second reaction vessel in the range of 350° to 470° C. respectively.

The preliminary reaction vessel 3 has an open end at the top. This opening is closed with a removable lid 3*a*. At the bottom of the preliminary reaction vessel 3 is disposed transfer means 9 formed of a screw feeder and adapted to transfer the catalyst and the molten plastic mass from the preliminary reaction vessel 3. The leading end of the transfer means 9 is situated above the first reaction vessel 1. On the external surface of the preliminary reaction vessel 3 is disposed a heater (not shown) which is adapted to maintain the internal temperature of the preliminary reaction vessel at a stated temperature such as, for example, 360° C.

The means 4 for the removal of the deteriorated catalyst is formed of a screw feeder, for example, and is connected to the bottom of the first reaction vessel 1.

In the third embodiment described above, the plastic scraps are fed in conjunction with the burnt zeolite catalyst into the preliminary reaction vessel 3 through the upper end opening. Inside this preliminary reaction vessel 3, part of the plastic scraps are reduced to a molten state by thermal decomposition.

The plastic scraps now in a molten state are forwarded in conjunction with the catalyst by the transfer means 9 into the first reaction vessel 1. Inside the first reaction vessel 1, the mixture of the molten plastic mass with the catalyst is uniformly stirred by the use of the stirrer means 5 and, at the same time, heated at temperatures in the range of 400° to 470° C.

As a result, the molten phase within the first reaction vessel 1 is uniformly heated and, at the same time, the plastic scraps are thermally decomposed and part of them undergo reforming and distillation.

The vaporous product distilled from within the first reaction vessel 1 is passed through the catalyst bed formed inside the second reaction vessel 2. During the passage through this catalyst bed, the vaporous product undergoes catalytic decomposition and reforming because the internal temperature of this reaction vessel is maintained in the range of 350° to 470° C. owing to the thermal capacity of the vaporous product and the heat from the external heater.

In the meantime, the catalyst which has contributed to the thermal decomposition of plastic scraps within the first reaction vessel 1 is gradually deteriorated because of deposition of carbon thereon and is caused to gain in weight. The deteriorated catalyst, therefore, sinks to the bottom of the first reaction vessel 1. After it has collected to some volume, it is drawn out of the first reaction vessel 1 by the operation of the means 4.

The deteriorated catalyst thus removed from the first reaction vessel 1 is heated to about 500° C., so that the deposited carbon will be converted into carbon dioxide and released from the catalyst. The catalyst, when being activated, can be put to re-use.

The catalyst to make up the deteriorated catalyst removed as described above is fed from the preliminary reaction vessel 3 in conjunction with newly supplied plastic scraps to the first reaction vessel 1. The extent of the replenishment of the catalyst can be freely adjusted by suitably changing the mixing ratio of the plastic scraps and the catalyst fed to the preliminary reaction vessel 3.

To the rear side of the second reaction vessel 2 is connected a cooling tube 11 which is provided on the exterior thereof with a condenser 10. The cooling tube 1 is provided at the leading end thereof with an oil reservoir 12.

The vaporous distillate which has been reformed by thermal decomposition within the second reaction vessel 2 is cooled while it is traveling through the cooling tube 11. The resultant condensate is collected in the oil reservoir 12. Above the oil reservoir 12 is disposed a gas meter 13 adapted to measure the volume of the gas. The formed oil which is collected in the oil reservoir 12 can be drawn out by opening a valve 14.

Control of the internal temperature of the first reaction vessel 1 may be facilitated by the observation of the thermometer 6. Control of the head of the molten phase within the first reaction vessel 1 may be carried out by observation of the level gauge 7.

In accordance with the first embodiment of this invention, the thermal decomposition within the first reaction vessel 1 is carried out in the absence of a catalyst. Thus, the plastic scraps are not accompanied by the catalyst. They are fed alone to the preliminary reaction vessel and to the first reaction vessel 1. From this point onward, the procedure of the aforementioned third embodiment is followed.

Thermal decomposition of plastic scraps was tried in the apparatus of the present embodiment under various conditions. The results were as shown below.

The apparatus for thermal decomposition used in this experiment had a construction as illustrated in FIG. 1. The first reaction vessel was made of iron and had an inner volume of 70 liters and the second reaction vessel was made of iron and had an inner volume of 35 liters.

Raw materials, which were polyethylene containers and agricultural polyethylene films discarded as useless, were supplied to the preliminary reaction vessel 3 and therewithin heated to 360° C., fed, in a molten state, to the first reaction vessel 1 by the screw feeder 9 and subjected therein to thermal decomposition.

Inside the second reaction vessel, the vaporous product distilled out inside the first reaction vessel 1 was treated. In a first test run, the first reaction vessel and the second reaction vessel both used zeolite as a catalyst and the thermal decomposition was carried out at 430° C. In a second test run, the conditions were the same as those of the first test run, except that the thermal decomposition was carried out at 450° C. In a third test run, only the second reaction vessel used a catalyst and the thermal decomposition was carried out at 450° C. The results were as shown in Table 1.

In a first comparative test run, only the first reaction vessel used a catalyst. In a second comparative test run, no catalyst was used in either of the two reaction vessels. The results were as shown in Table 1.

high quality having small average molecular weights. Particularly in the second test run, the speed of the distillation (amount of treatment) was notably high.

In the comparative test runs wherein no catalyst was used in either of the two reaction vessels and a catalyst was used only in the first reaction vessel, the products were waxy, had high average molecular weights, and exhibited poor states.

Figure 2:
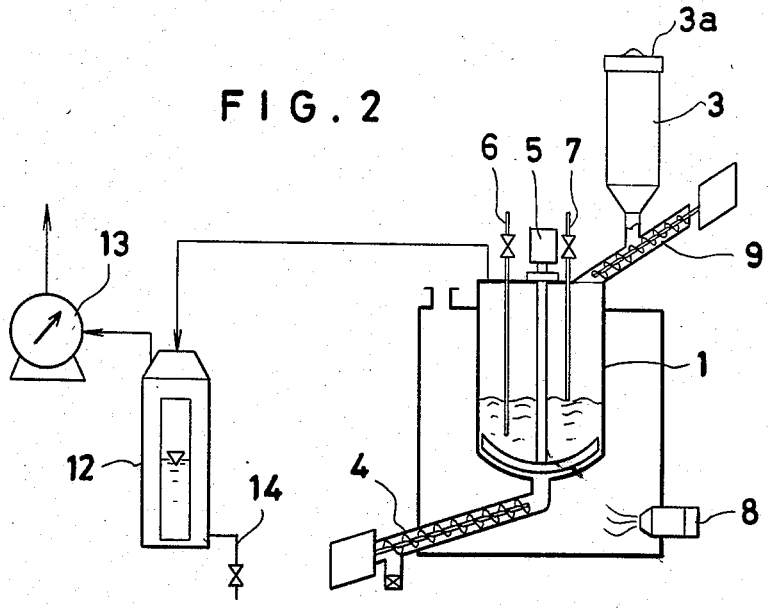
FIG. 2 is a schematic diagram illustrating another typical apparatus of this invention for thermal decomposition of plastic scraps.

The apparatus for thermal decomposition used for working the second embodiment of this invention is illustrated schematically in FIG. 2.

The apparatus of FIG. 2 is the same as the apparatus of FIG. 1 but lacks the second reaction vessel 2 and the cooling tube 11. In this apparatus, therefore, the distillate emanating from the first reaction vessel 1 is directly led to the oil reservoir 12. The components of this apparatus which are identical or similar to the components of FIG. 1, therefore, are designated by like symbols. These components are not described below to avoid repetition.

Plastic scraps are fed in conjunction with a burnt zeolite catalyst into the preliminary reaction vessel 3 through the upper open end. Inside the preliminary reaction vessel, part of the plastic scraps are partially decomposed with heat and reduced to a molten state. The amount of the catalyst to be added is required to be not less than 5% by weight based on the plastic scraps. Practically, it is in the range of 5 to 10% by weight.

The molten plastic mass is now forwarded in conjunction with the catalyst by the transfer means 9 to the first reaction vessel 1. Inside the first reaction vessel 1, the mixture of the molten plastic mass and the catalyst is stirred by the stirrer means 5 and, at the same time, heated at a temperature in the range of 400° to 470° C.

As a result, the molten phase within the first reaction vessel 1 is heated uniformly to cause thermal decomposition of the plastic mass. Further, part of the plastic mass is reformed and distilled out.

The vaporous product distilled out of the first reaction vessel 1 is led to the oil reservoir 12, to be collected therein.

The catalyst which has been deteriorated by use within the first reaction vessel 1 is suitably removed out of the vessel by the same means 4 as used in the apparatus of FIG. 1. The removed catalyst is activated and put to re-use.

Thermal decomposition of plastic scraps was tried in the apparatus of the present embodiment under various conditions. The results were as shown below.

Polyethylene containers and agricultural polyethylene films discarded as useless were adopted as plastic scraps. These plastic scraps were mixed with about 10% by weight of burnt zeolite catalyst particles of an average diameter of 10 mm and fed to the preliminary reaction vessel 3, heated to 360° C. and reduced to a molten

TABLE 1

| Conditions of thermal decomposition | | | | | | | | | |
|---|---|---|---|---|---|---|---|---|---|
| First reaction vessel | | Second reaction vessel | | | | Average molecular weight | Molecular-weight distribution | Molecular weight distribution | Amount treated |
| Temperature (°C.) | Catalyst | Temperature (°C.) | Catalyst | Yield (wt %) | State | ($\overline{Mw}$) | | $C_5$–$C_{15}$ (wt %) | (kg/hr) |
| 430 | Yes | 430 | Yes | 85.0 | Liquid | 141 | $C_5$–$C_{27}$ | 89.0 | 2.8 |
| 450 | Yes | 450 | Yes | 77.0 | Liquid | 145 | $C_5$–$C_{30}$ | 85.0 | 6.0 |
| 450 | No | 450 | Yes | 74.2 | Liquid | 156 | $C_5$–$C_{32}$ | 81.0 | 1.8 |
| | | | | Comparative test | | | | | |
| 450 | Yes | 450 | No | 68.6 | Wax | 498 | $C_{17}$–$C_{54}$ | 0.0 | 6.0 |
| 450 | No | 450 | No | 73.7 | Wax | 278 | $C_5$–$C_{42}$ | 31.0 | 1.8 |

From the table given above, it is noted that when plastic scraps were treated in accordance with this invention, the products were liquid hydrocarbon oils of state, then transferred by the screw feeder 9 to the first reaction vessel 1, there to be subjected to thermal decomposition. In one test run, the temperature of the thermal decomposition within the first reaction vessel was 430° C. In another test run, the temperature was 450° C. The yields of the distillate and the amounts of treatment were as shown in Table 2. For comparison, the same procedure was repeated, except that the addition of the catalyst to the plastic scraps was omitted. The results were as shown in the same table.

TABLE 2

| Conditions of thermal decomposition | | Amount treated | Yield of distillate |
|---|---|---|---|
| Temperature (°C.) | Catalyst | (kg/hr) | (wt %) |
| 430 | Yes | 2.80 | 90.2 |
| 450 | Yes | 6.00 | 90.1 |
| | Comparative test | | |
| 430 | No | 0.78 | 32.9 |
| 450 | No | 1.80 | 83.6 |

It is noted from the table given above that the test runs using the catalyst according to the present invention excelled the comparative test runs using no catalyst, in terms of amount of treatment and yield of distillate. The distillates obtained in the test runs of the present invention were both liquid hydrocarbon oils. Those obtained in the comparative test runs using no catalyst were both waxy.

Obviously, many modifications and variations of the present invention are possible in light of the above teachings. It is therefore to be understood that within the scope of the appended claims, the present invention may be practiced otherwise than as specifically described herein.

What is claimed is:

1. A method for the thermal decomposition of plastic scraps, comprising the steps of:

melting said plastic scraps by the application of heat so as to obtain a molten plastic mass;

heating said molten plastic mass to a temperature within the range of 440° C. to 470° C. so as to thereby effect the thermal decomposition of said molten plastic mass and obtain a vaporous product;

conducting said vaporous product through a catalyst bed heated to a temperature within the range of 350° C. to 470° C. so as to subject said vaporous product to secondary catalytic decomposition whereby hydrocarbons having a narrow molecular weight distribution emanate from said catalyst bed; and recovering said hydrocarbons emanating from said catalyst bed.

2. A method according to claim 1, wherein said plastic scraps are polyolefinic plastics.

3. A method according to claim 1, wherein:

said catalyst bed is comprised of catalyst particles selected from the group consisting of alumina-iron oxide type, silicic acid-iron oxide type, and zeolite type catalyst particles.

4. A method as set forth in claim 1, wherein:

said catalytic bed is comprised of catalyst particles having a diameter within the range of 1 to 15 mm.

5. A method for the thermal decomposition of plastic scraps, comprising the steps of:

mixing said plastic scraps with catalyst particles such that said catalyst particles are added to said plastic scraps in an amount within the range of 5–10% by weight based upon the amount of said plastic scraps;

melting said mixture of said plastic scraps and said catalyst particles by the application of heat so as to obtain a molten mass of said platic scraps and said catalyst particles;

heating said molten mass of plastic scrap material and said catalyst particles to a temperature within the range of 440° C. to 470° C. so as to thereby effect catalytic decomposition of said molten mass of said plastic scrap material by contact with said catalyst particles and obtain a vaporous product; and recovering said vaporous product of said catalytic decomposition.

6. A method according to claim 5, which further comprises:

separating and recovering said catalyst particles from said molten mass of said plastic scrap material and said catalyst particles which has undergone said catalytic decomposition.

7. A method according to claim 6, wherein said catalyst particles are one member selected from the group consisting of alumina-iron oxide type, silicic acid-iron oxide type, and zeolite type catalyst particles.

8. A method according to claim 5, wherein said catalyst particles are one member selected from the group consisting of alumina-iron oxide type, silicic acid-iron oxide type, and zeolite type catalyst particles.

9. A method according to claim 5, wherein said catalyst particles have a diameter in the range of 1 to 15 mm.

10. A method as set forth in claim 5, wherein:

said plastic scraps are polyolefinic plastics.

11. A method for the thermal decomposition of plastic scraps, comprising the steps of:

mixing said plastic scraps with catalyst particles;

melting said mixture of said plastic scraps and said catalyst particles by the application of heat so as to obtain a molten mass of said plastic scrap material and said catalyst particles;

heating said molten mass of said plastic scrap material and said catalyst particles to a temperature within the range of 440° C. to 470° C. so as to thereby effect catalytic decomposition of said molten mass of said plastic scrap material and said catalyst particles and obtain a vaporous product;

conducting said vaporous product through a catalyst bed heated to a temperature within the range of 350° C. to 470° C. so as to subject said vaporous product to secondary catalytic decomposition whereby hydrocarbons having a narrow molecular weight distribution emanate from said catalyst bed; and recovering said hydrocarbons emanating from said catalyst bed.

12. A method according to claim 11, wherein said catalyst particles mixed with said plastic scraps are one member selected from the group consisting of alumina-iron oxide type, silicic acid-iron oxide type, and zeolite type catalyst particles.

13. A method according to claim 11, wherein:

said catalyst bed is comprised of catalyst particles selected from the group conisting of alumina-iron oxide type, silicic acid-iron oxide type, and zeolite type catalyst particles.

14. A method according to claim 11, wherein said catalyst particles mixed with said plastic scraps are added in an amount in the range of 5 to 10% by weight based on the amount of said plastic scraps.

15. A method according to claim 11, which further comprises:

separating and recovering said catalyst particles from said molten mass of said plastic scrap material and said catalyst particles which has undergone said catalytic decomposition.

16. A method as set forth in claim 11, wherein:

said catalyst bed is comprised of catalyst particles having a diameter within the range of 1 to 15 mm.

17. A method as set forth in claim 11, wherein:

said plastic scraps are polyolefinic plastics.

* * * * *